United States Patent [19]

Wakuluk

[11] Patent Number: 4,504,102

[45] Date of Patent: Mar. 12, 1985

[54] ELECTRIC CONNECTING SYSTEM

[75] Inventor: Augustine Wakuluk, Bethel, Conn.

[73] Assignee: T-Bar Incorporated, Wilton, Conn.

[21] Appl. No.: 421,855

[22] Filed: Sep. 23, 1982

[51] Int. Cl.[3] ..... H01R 13/62

[52] U.S. Cl. ..... 339/18 R; 339/97 P; 339/99 R; 339/154 A; 339/176 MF

[58] Field of Search ..... 339/17 F, 176 MF, 97 R, 339/97 P, 98, 99 R, 18 R, 18 P, 154 R, 154 A, 155 R, 156 R; 29/867, 854, 861

[56] References Cited

U.S. PATENT DOCUMENTS

| | | | |
|---|---|---|---|
| 1,569,869 | 1/1926 | McIntosh | 339/154 R |
| 3,034,091 | 5/1962 | Gluck | 339/17 F |
| 3,144,288 | 8/1964 | Grant | 339/17 F |
| 3,813,634 | 5/1974 | Wigby et al. | 339/176 MF |
| 4,253,722 | 3/1981 | Fox, Jr. | 339/176 MF |
| 4,402,564 | 9/1983 | Frantz | 339/176 MF |

FOREIGN PATENT DOCUMENTS

| | | | |
|---|---|---|---|
| 2081986 | 2/1982 | United Kingdom | 339/17 F |

*Primary Examiner*—John McQuade
*Assistant Examiner*—Thomas M. Kline
*Attorney, Agent, or Firm*—John C. Dorfman

[57] ABSTRACT

An electrical connection adapter and method for using the same is provided for connecting the fixed electrical terminals of a unit which are positioned in a regular matrix with an array of parallel electrical conductors. An intermediate adapter provides parallel passages through an insulating housing in which formed flat conductors across the width of the passages provide spring elements to engage the terminal contacts of the matrix in good electrical contact within the passages. Intermediate connector elements having adapter portions considerably narrower than the passages provided. The adapter portions are fixedly connected to self-cutting and connecting contacts laterally offset from the centerlines of their adapter portions. Spring contact means is provided by the adapter portions of the intermediate connector elements to permit insertion of the adapter portions into the passages at variable orientations to engage the flat conductors and permit the contacts to be placed in the variety of positions needed to contact the parallel electrical conductors. The connector elements are then cast into that position. The parallel electrical conductors are held in place by a back up member permitting penetration cutting and contacting by the contacts of the connector elements.

10 Claims, 8 Drawing Figures

ELECTRIC CONNECTING SYSTEM

FIELD OF INVENTION

The present invention relates to an electrical connecting system and method for connecting the fixed electrical terminals of a unit with a predetermined array of electrical conductors.

BACKGROUND OF THE INVENTION

It is often desirable to connect the fixed electrical terminals of a unit, such as relay switches, with a series of electrical conductors. It would be extremely inefficient and wasteful of labor to manually and successively connect each electrical conductor with its respective electrical terminal, and particularly inefficient whenever more than a few connections are required. To avoid such inefficiency, connector systems enable simultaneous termination of the electrical conductors with the fixed electrical terminals.

An adapter providing an intermediate array of connector elements may sometimes be employed to enable transition from the terminal array of the unit to the conductor array. However, if the pattern of the electrical terminals of the unit does not correspond to the pattern of the electrical conductor configuration, the intermediate connector elements must typically be custom designed to compensate for the varying offsets between each of the electrical conductors and their respective electrical terminals. If numerous connections are required, it may become necessary to employ a wide variety of differing connector elements. However, it is inefficient to fabricate and utilize a different connector element to interconnect each electrical conductor with its corresponding electrical terminal in order to compensate for the varying offsets therebetween. In fact, it is desirable to minimize the amount of differing connector elements needed to effectuate the interconnection of the terminals and their respective electrical conductors.

In accordance with the present invention an electrical connecting system and method is provided for connecting the fixed electrical terminals of a unit with a series of corresponding electrical conductors which eliminates the inefficiencies and the labor intensification problems associated with the conventional connection methods and systems.

SUMMARY OF THE INVENTION

In accordance with the present invention, an electrical connection adapter and method for using the same is provided for connecting electrical terminals supported at fixed positions on a unit with electrical conductors disposed in a predetermined array. The system comprises conductor-support means for supporting the conductors in the predetermined array. An intermediate adapter unit provides a plurality of passages extending in generally parallel paths through the intermediate adapter unit and located so that they will receive the respective terminals of the unit. A terminal connector member is provided extending through each passage and having a flat portion resting along one flat passage wall and a resilient portion extending between opposite walls yielding to the respective terminals of the unit and thereby making good electrical contact with the terminal as the terminals are inserted into the passages. An intermediate conductor connector element is provided for engaging and making electrical contact with an electrical conductor in said predetermined array and having as an integral part an adapter member for conductively engaging a terminal connector member. The adapter member includes resilient engagement means which bears against the flat portion of a terminal connector member supported against one wall of a passage and the opposing wall of the passage. The resilient engagement means is laterally narrower than the passage so that it may be variously positioned in the passage to achieve conductive engagement with the terminal connector member at different orientations to enable the conductor connector element to be moved laterally in its passage in order to be positioned to engage a predetermined corresponding conductor in said array.

In accordance with the present invention a method is provided for connecting a predetermined array of electrical conductors with corresponding fixed electrical terminals of a unit. An intermediate adapter unit is provided having a plurality of generally parallel passages so located that they will receive the respective terminals of the unit. Terminal connector members are retained in selected positions relative to the passages in a position to make good electrical contact with the terminals. Connector conductor elements are placed in the passages in contact with the terminal connector members. The connector conductor elements are laterally positioned in the passages until they match up with positions of different conductors in the predetermined array. The connector conductor elements are fixed in the adapter unit in position permitting simultaneous engagement with the conductors in the array and with the terminal connector members to provide separate and continuous electrically conductive paths between the terminals of the unit and the conductors in the array when the terminals of the unit are placed in contact with the terminal connector members.

BRIEF DESCRIPTION OF THE DRAWINGS

The foregoing summary as well as the following detailed description of the preferred embodiment of the invention will be better understood when read in conjunction with the appended drawings in which.

DETAILED DESCRIPTION OF THE INVENTION

Figure 1:
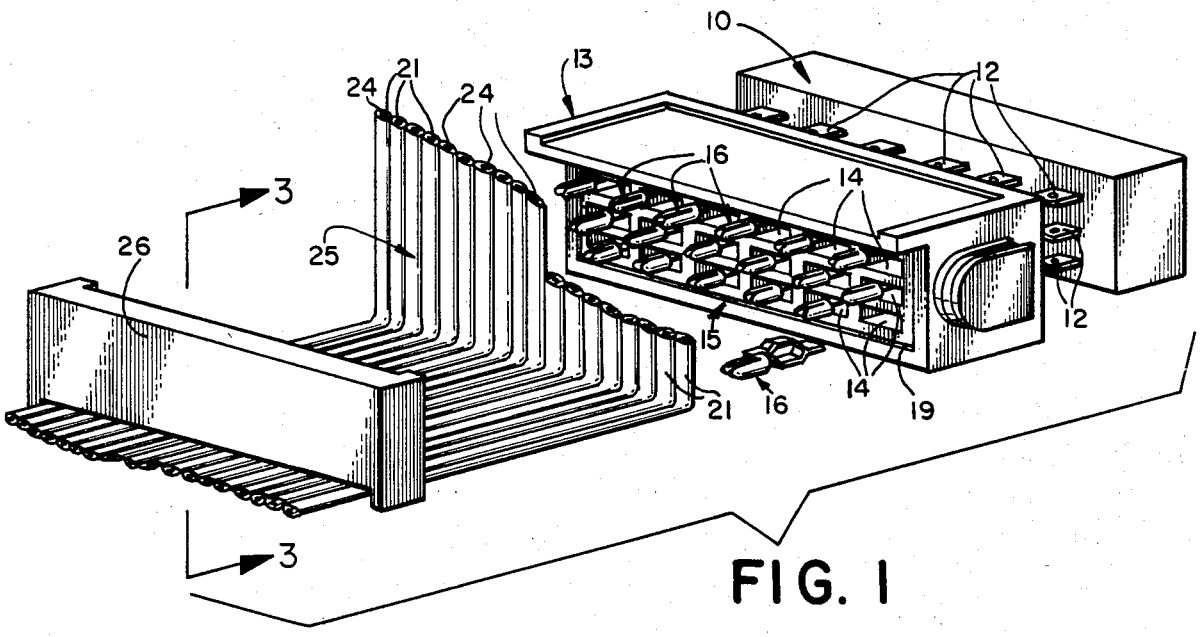
FIG. 1 is a partially exploded perspective view of a electrical connecting system in accordance with the preferred embodiment of the present invention.

Referring to FIG. 1 of the drawings, an electrical connecting system in accordance with the present invention is depicted. The electrical connecting system is designed to engage an electrical unit 10 which presents a fixed array of terminals 12, here shown as flat parallel rectangular prong extensions of conductors within the unit and supported by the insulating housing of the unit. The terminals present a 3×6 matrix arrangement at one end of the generally rectangular unit. Typically, but not necessarily, unit 10 is an active electrical device. In a preferred embodiment of the present invention it is an electrical switching device of the type specifically described in U.S. Pat. No. 3,226,508 for an "Electrical Switch Device". The electrical contacts 12 protruding from the switching device 10 enable external electrical connections with the switching device 10 and function as electrical terminals for the switching device 10.

The electrical connecting system includes an intermediate adapter element 13 for interconnecting the terminals of the switching device 10 with a set of electrical conductors 24 configured in parallel side-by-side relationship, preferably, as illustrated in FIG. 1, in the form of ribbon cable 25. Each conductor 24 is separated by insulation 21 molded or otherwise formed together into ribbon cable 25.

Figure 5:
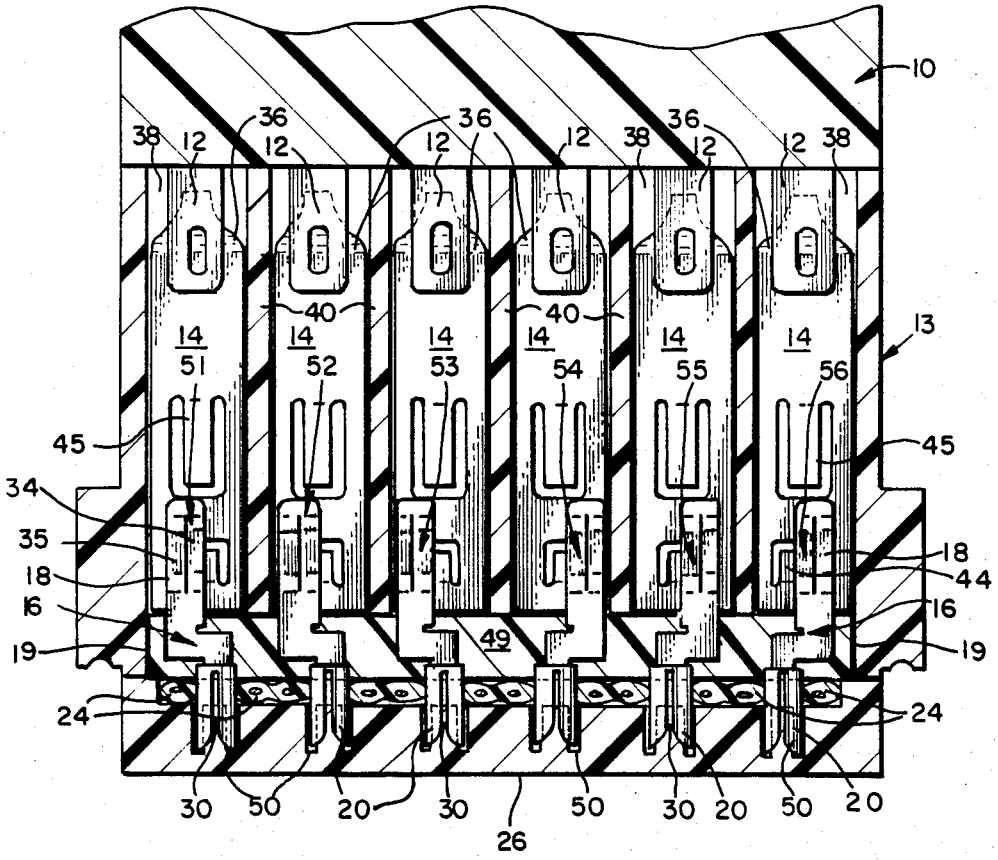
FIG. 5 is a cross-sectional view of the system illustrated in FIG. 1 as taken along line 5—5 of FIG. 3.
Figure 3:
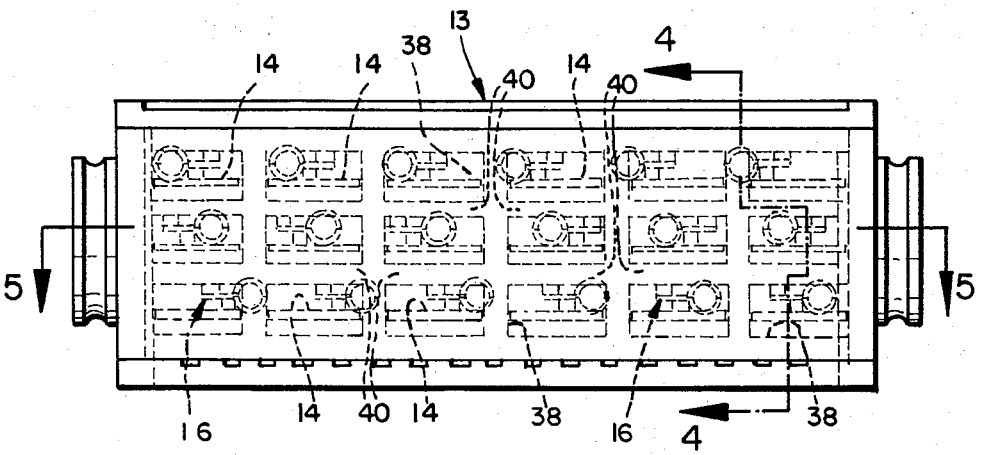
FIG. 3 is an end view of the system illustrated in FIG. 1 as taken along line 3—3 of FIG. 1.
Figure 4:
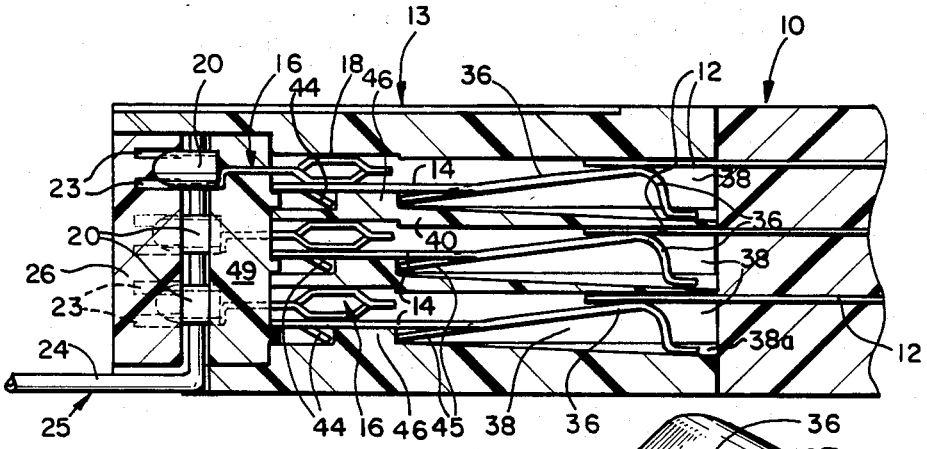
FIG. 4 is a cross-sectional view of the system illustrated in FIG. 1 as taken along line 4—4 of FIG. 3.

The intermediate adapter unit 13 includes an insulating housing providing eighteen separate mutually parallel passages 38 through the housing which in cross section are generally rectangular and which are arranged in a 3×6 orthogonal matrix of columns and rows. As illustrated in FIGS. 3, 4 and 5, the passages 38 extend generally parallel to one another through the insulating housing of the intermediate adapter unit 13 from face 15 to the parallel face at the opposite end thereof. The passages 38 are defined between a generally horizontal and vertical grid of inner passage-defining walls 40 which extend from face 15 through the housing to a generally parallel face at the opposite end of the housing. The passage-defining walls 40 are disposed generally perpendicular to one another so that the generally uniform rows and columns of passages 38 having generally rectangular cross-sections are defined between the grid walls 40. As best seen in FIG. 4, the passages 38 are actually non-uniform in cross-section along their lengths.

The housing supports eighteen generally flat electrical conductors 14 within the respective passages 38 and the conductors 14 serve as terminal connector members. The conductors 14 are generally coextensive with the passages 38 through the housing and at one end of the passages proximate to face 15 of the housing the conductors are supported against one of the passage-defining walls 40 of the adapter unit. As illustrated in FIGS. 3 and 4, the conductors 14 lie on the bottom of each passage at face 15 of the housing and extend across the width of the passages at least at face 15 of the housing.

Figure 2:
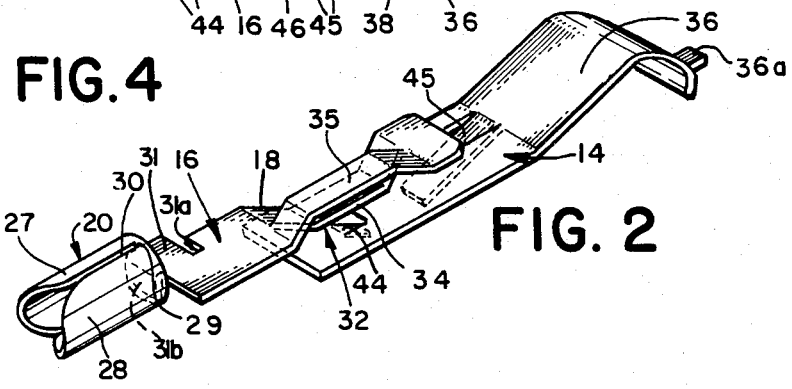
FIG. 2 is an enlarged perspective view of an intermediate connector element in accordance with the present invention.

Each of the generally flat conductors 14 are shaped to include a spring portion 36 (as illustrated in FIGS. 2 and 4) which functions to make electrical contact with a unit terminal 12 which is inserted into the end of one of the housing passages 38 at positions opposite face 15. As specifically illustrated in FIGS. 4 and 5, the shaped flat conductors 14 are held in each of the longitudinal passages by stop tabs 44 and 45 which abut the shoulders on opposite sides of a ridge 46 disposed transverse to each passage 38 proximate face 15. The conductors 14 are most easily inserted into the passages 38 from the end remote from the ridge 46. From that same end, a narrow longitudinal groove **38*a* is provided along a wall 40 of each passage 38 opposite the parallel wall 40 proximate spring position 36. Each groove 38*a* is of sufficient width to receive and engage an end tab 36*a* of spring 36 to properly align the conductor 14 within the passage 38. The tab 36*a* provides a sliding base for spring 36 as conductor 14 is inserted into passage 38**.

Referring to FIGS. 2 and 3, the spring portion 36 of each shaped flat conductor is designed to be compressed between the wall having groove **38*a* and the opposing wall of the passage 38. Spring 36 is displaced by the terminal 12 of switching unit 10 as the terminal enters the passage 38 but the resilience of the spring portion assures good electrical contact. The effect is repeated over the entire matrix of passages so that each of the terminals 12 is plugged into a passage 38 and engages spring portion 36 of one of the conductors 14**.

The flat conductors 14 provide at their ends distal spring portions 36 which are adapted to lie flat on the bottoms of passages 38 and provide plug receptacles at face 15 of the housing so as to conductively engage intermediate connector elements 16 which are insertable into the plug receptacles at face 15, as best seen in FIG. 2. The intermediate connector elements 16 function to interconnect each flat conductor 14 of the intermediate adapter unit with a different predetermined conductor 24 of ribbon cable 25. For this purpose, each of the intermediate connector elements 16 is constructed of an electrically conductive material and includes an integral spring contact member 32 that is compressed and snugly engaged within a housing passage 38. It is removably insertable into such passage above the flat conductor 14. To engage one of the conductors 24 of the ribbon cable, each of the intermediate connector elements 16 includes an insulation displacement type contact 20 conductively fixed to a spring member 32 of an intermediate adapter portion 18.

As illustrated in FIG. 1, the individual electrical conductors 24 are provided as standard ribbon cable 25 and are held aligned, side by side, essentially equally spaced apart by the insulation. As illustrated in FIG. 2, to cut through insulation 21 and conductively engage an electrical conductor 24 in good electrical contact, the insulation displacement contact 20 is formed of a short tubular member having diametrically opposed deep cut slots 30 at one end which form a pair of opposing co-axial half tubular insulation piercing members 27 and 28. The cutting edge of each member 27 and 28 is arcuately shaped at the slotted end of contact 20. The uncut tubular portion provides an annular base member 29 of the contact 20. The arcuate front cutting edges of the co-axial half tubular members 27 and 28 taper toward the slots 30 so that each slot defines a conductor receiving space smaller than the conductor diameter for receiving the conductor as the insulation is pierced and stripped away by members 27 and 28.

To support the ribbon cable 25 in a predetermined position, a ribbon cable retainer 26 is provided. The ribbon cable retainer 26 is a generally rectangular solid block of insulating material and, as illustrated in FIGS. 1, 4 and 5, is channeled along two adjacent faces to receive the ribbon cable bent at a right angle along the longitudinal axes of the conductors 24 proximate one end of the cable. The cable retainer 26 is adapted to retain and support the electrical conductors 24 of a ribbon cable 25 against a backplane which retains the conductors against cutting and displacing forces applied by contacts 20. The wall of the cable retainer 26 disposed behind the ribbon cable is provided with a pattern of tubular recesses 23 for receiving the tubular cutting edges 27 and 28 after they have cut through the insulation. After cutting the insulation, the edges 27 and 28 bracket the conductors which are received by the corresponding recesses 23 as the edges of the slots 30 engage the conductor 24.

As illustrated in FIG. 2, the intermediate connector element 16 is a die punched and formed member of beryllium copper or other conductive spring metal which over most of its length is only about half as wide as the flat conductor 14 at face 15 of the intermediate adapter. An exception is at an end extension portion 31 which supports contact member 20. End portion 31 serves as a lateral connector extension and extends laterally beyond the normal width of intermediate adapter portion 18 and is provided with slot 31*a* which separates it from the adapter portion 18 for greater flexibility. An integral mounting tab 31*b* is provided on end portion 31 and is fixedly connected to the tubular rim 29 at the base of contact member 20. The tubular, insulation piercing, contact member 20 is affixed to tab 31*b* by welding, soldering or other permanent conductive attachment. Tab 31*b* is bent at right angles to the end portion 31 and positioned at the extreme edge of end portion 31 so that the central longitudinal axis of the tubular contact 20 is disposed generally parallel to and laterally offset beyond the edge of most of the intermediate adapter portion 18.

The adapter portion 18 of the intermediate connector element 16 includes spring portion 32 having oppositely deformed integral spring members 34 and 35 which are resiliently deformed and function as a plug member for insertion into passages 38 at face 15 of the housing. The portion of the shaped flat conductors 14 proximate face 15 serves as the electrical contact engaging surface for one of the oppositely directed spring members 34 and 35 of the connector element 16 upon insertion of the adapter portion 18 into the passage 38. The spring members 34 and 35 are adapted to engage and be resiliently deformed by the walls of passage 38 and conductor 14 so that the connector element 16 is held in good electrical contact with conductor 14. The spring-loading members 34 and 35 enable the adapter member to be easily removable from the passage 38 and laterally shiftable within the passage. Spring members 34 and 35 are formed so that the adapter can be inverted by rotating about its longitudinal axis and be inserted into a passage and perform the same function with conductor 14.

As illustrated in FIGS. 3 and 5, the lateral width of the passages 38 is much greater than the uniform width of the adapter portions 18 of connector elements 16 over the major portion of their length, typically on the order of twice the width. In addition, the lateral extension 31 at the external end of the adapter never enters the passages but enables the tubular contacts 20 to be offset laterally beyond the lateral edges of the passages and overlapping the intermediate wall 40 at face 15. The distance of lateral spacing of passages 38 is usually different from the lateral pitch or distance of lateral spacing between the electrical conductors 24 of the ribbon cable 25 positioned in their predetermined parallel array. FIG. 5 specifically illustrates how the adapter portions 18 of the connector elements 16, including spring members 34 and 35, have a smaller horizontal width than the passages 38 and can be shifted laterally within the passages. As depicted in FIGS. 1 and 3, the adapter portions 18 are distributed across the widths of the passages to achieve a configuration having their contacts 20 matching conductors 24 of ribbon cable 25. By making the insertable adapter portions 18 of connector elements 16 relatively quite narrow with respect to the receptacle passages 38 at face 15, a wide range of positions for the contacts 20 is achieved. By providing lateral extension 31, the range is extended beyond the bounds of the passage sidewalls. The same intermediate connector element 16 may be rotated 180° about its axis and inserted into the passages 38 and a further range is provided. As a consequence, it is not necessary to construct numerous differing connector elements having different lateral offsets between the longitudinal axis of the adapter portion 18 and the longitudinal axis of the contact 20 because in accordance with the invention one uniform connector element 16 has been utilized in each of the passages 38 to connect each contact 20 with a corresponding conductor 14 in the array.

Once the connector elements have been set in properly selected positions such that each of the contacts 20 is opposed to a conductor in the ribbon array, the contacts are moved into the ribbon array 25 and connect to a different conductor 24. The adapters 18 may be anchored into position by a potting technique using an epoxy resin or other suitable material which is poured in fluid form into the mold provided by peripheral wall 19 around the recessed face 15 (as seen in FIG. 1). The solidified resin provides a supporting wall 49 to hold each terminal 20 in its selected position.

Figure 7:
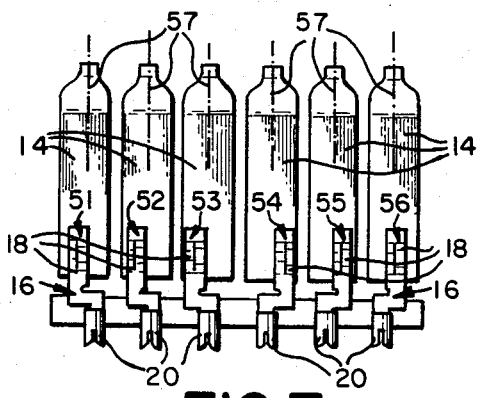

Referring to FIG. 5, the middle row of passages of the intermediate adapter unit 13 are depicted in cross-section in which half of the connector elements 16 are rotationally shifted 180° from the other half so that the contact 20 of each intermediate connector element 16 can either be offset to the left or to the right of its adapter portion 18. As viewed in FIG. 5 and more specifically in FIG. 7, the left half of the middle row of electrical terminals 20 of the intermediate adpater unit 13 receives intermediate connector elements 16, individually designated in FIG. 7 as 51, 52 and 53, which are oriented so that each contact 20 is laterally offset to the right of the longitudinal axis of its respective adapter portion 18. As specifically depicted in FIG. 7, the connector elements 51, 52 and 53 are laterally shifted to the left of the central longitudinal axis 57 of each shaped flat conductor 14 and each adapter portion 18 is shifted to the left different distances of lateral displacement relative to the longitudinal axis 57. The connector elements 16 for the right half of the shaped flat conductors 14 are individually designated as 54, 55 and 56. Connector elements 54, 55 and 56 are inverted with respect to connector elements 51, 52 and 53 and are oriented so that their respective contacts 20 are laterally offset to the left of their corresponding adapter portions 18. The connector elements 54, 55 and 56 are laterally oriented to the right of the longitudinal axis 57 of their respective flat conductors 14 with each adapter portion 18 of the connector elements 54, 55 and 56 being laterally displaced to the right of the longitudinal axis 57 of its respective flat conductor 14 a different distance of lateral displacement to permit the contact 20 of each connector element 16 to engage a corresponding electrical conductor 24 positioned in the predetermined array 25 of electrical conductors.

Figure 6:
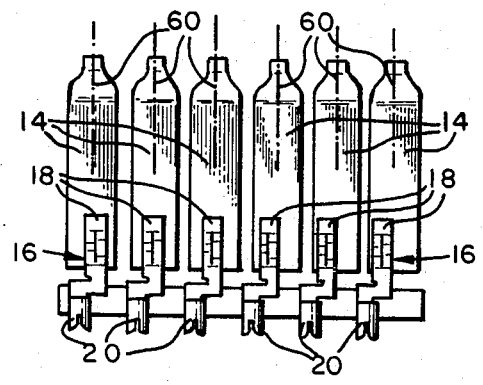
FIGS. 6, 7 and 8 are sectional views similar to FIG. 5 taken at each of the terminal-connected levels of an intermediate adapter unit but showing only the intermediate connector elements and the terminal-connector conductors of the intermediate adaptor unit.

FIG. 6 represents the upper row of the shaped flat conductors 14 of the intermediate adapter unit 13 illustrated in FIG. 3. Connector elements 16 are oriented so that each has its respective contact 20 offset to the left of the longitudinal axis of its respective adapter portion 18. Each contact 20 is laterally shifted to the left of the central longitudinal axis 60 of its engaging flat conductor 14. Each contact 20 is displaced to the left a different distance of lateral displacement from its corresponding axis 60 to permit the contact 20 of each connector element 16 to engage a corresponding electrical conductor 24.

Figure 8:
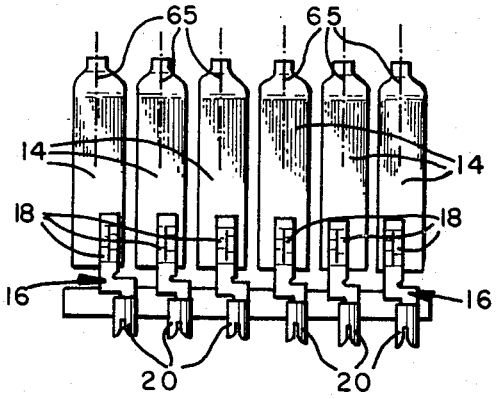

FIG. 8 represents the bottom row of shaped flat conductors 14 of the intermediate adapter unit 13 illustrated in FIG. 3. Connector elements 16 are rotationally oriented so that their respective contacts 20 are offset to the right of the longitudinal axis of their respective adapter portions 18. Relative to the engaging flat conductor 14, each contact 20 is laterally shifted to the right of the central longitudinal axis 65 of its respective flat conductor 14 a different distance from the others to permit the contact 20 of each connector element 16 to engage a corresponding electrical conductor 24 positioned in the predetermined array 25 of electrical conductors, as illustrated in FIG. 1.

Thus, it has been shown that to accomplish the transition between fixed electrical terminals 12 of a switch unit 10 and an array of electrical conductors 24 of a ribbon cable 25, an intermediate matrix adapter unit 13 employing a single form of intermediate connector elements 16 is utilized. However, while certain preferred embodiments of the present invention have been illustrated and described, the present invention is not limited thereto but may be variously embodied by one skilled in the art within the scope of the following claims.

What is claimed is:

1. An electrical connecting system for connecting electrical terminals supported at fixed positions on a unit with electrical conductors in a predetermined array comprising:

conductor-support means for supporting said conductors in said predetermined array;

an intermediate adapter unit providing a plurality of passages extending in generally parallel paths through the intermediate adapter unit located so that they will receive the respective terminals of the unit and having passage-defining walls with at least one generally flat reference wall parallel to the flat reference walls of other passages and opposing another wall of the passage;

a terminal connector member extending through each passage having a flat portion resting along the flat reference wall and a resilient portion extending between the passage-defining walls yielding to the respective terminals of said unit and thereby making good electrical contact with the terminals as said terminals are inserted into the passages; and a conductor connector element for engaging and making electrical contact with the electrical conductors in said predetermined array having as an integral part an adapter member for conductively engaging said terminal connector member, said adapter member having resilient engagement means which bears against the flat portion of the terminal connector members resting against the flat reference wall of a passage and against the opposing wall of the passage and which is laterally narrower than the passage so that it may be variously positioned in the passage to achieve conductive engagement with the terminal connector member at different orientations to enable said conductor connector element to be moved laterally in its passage in order to be positioned to engage a predetermined corresponding conductor in said array.

2. An electrical connecting system in accordance with claim 1 wherein the width of each terminal connector member is selected to fit snugly within the passage-defining walls of the intermediate adapter unit to cooperate with the terminals of the unit and with the adapter members of the conductor connector elements and wherein the resilience of the resilient engagement means of each adapter member provides good electrical contact with the terminal connector member and permits lateral movement of said adapter member within the passage.

3. An electrical connecting system in accordance with claim 2 wherein said resilient engagement means of said adapter members includes an integral spring portion wider than the passages and compressed within a passage against a terminal connector member.

4. An electrical connecting system in accordance with claim 2 wherein said adapter member is narrower than the width of said passages enabling selected lateral positions within a passage.

5. An electrical connecting system in accordance with claim 1 wherein each conductor connector element includes a lateral connector extension extending the width of its adapter member outside the passage and a conductor contact fixedly connected to one end of the lateral connector extension for engaging a conductor and wherein said resilient engagement means is supported on an opposite end of the lateral connector extension from the conductor contact and wherein further the adapter member may be inverted to provide alternative positions for the connector contact.

6. An electrical connecting system for connecting a fixed electrical terminal of a unit with an electrical conductor comprising:

conductor-support means for supporting said conductor at a selected orientation;

an intermediate adapter unit providing at least one rectangular cross-sectional passage of a size to receive the terminal in one end of the passage and having passage-defining walls with at least one generally flat reference wall opposing another wall of the passage;

a terminal connector member extending through said passage having a flat portion resting along the flat reference wall and a resilient portion extending between the passage-defining walls yielding to the terminal and thereby making good electrical contact with the terminal as it is inserted into the passage;

a conductor connector element for engaging and making electrical contact with the electrical conductor having as an integral part an adapter member for conductively engaging said terminal connector member, said adapter member having resilient engagement means which bears against the flat portion of the terminal connector member resting against the flat reference wall of the passage and against the opposing wall of the passage and which is laterally narrower than the passage so that it may be variously positioned in the passage to achieve conductive engagement with the terminal connector member at different orientations to enable said conductor connector element to be moved laterally in its passage in order to be positioned to engage said conductor.

7. An electrical connecting system in accordance with claim 6 wherein the width of the terminal connector member is selected to fit snugly within the passage-defining walls of the intermediate adapter unit to cooperate with the terminal of the unit and with the adapter member of the conductor connector element and wherein the resilience of the resilient engagement means of the adapter member provides good electrical contact with the terminal connector member and permits lateral movement of the adapter member within the passage.

8. An electrical connecting system in accordance with claim 7 wherein said resilient engagement means of the adapter member includes an integral spring portion wider than the passage and compressed within the passage against a terminal connector member.

9. An electrical connecting system in accordance with claim 7 wherein said adapter member is narrower than the width of said passage enabling selected lateral positions within the passage.

10. An electrical connecting system in accordance with claim 6 wherein said conductor connector element includes a lateral connector extension extending the width of the adapter member outside the passage and a conductor contact fixedly connected to one end of the lateral connector extension for engaging a conductor and wherein said resilient engagement means is supported on an opposite end of the lateral connector extension from the conductor contact and wherein further the adapter member may be inverted to provide alternative positions for the connector contact.

* * * * *